United States Patent [19]

Sippel et al.

[11] Patent Number: 4,530,861

[45] Date of Patent: Jul. 23, 1985

[54] METHOD AND APPARATUS FOR MASKING A SURFACE OF A BLADE MEMBER

[75] Inventors: David F. Sippel; Robert L. Kearns, both of Cincinnati, Ohio

[73] Assignee: General Electric Company, Cincinnati, Ohio

[21] Appl. No.: 562,940

[22] Filed: Dec. 19, 1983

[51] Int. Cl.[3] ..... B05D 3/00; B05C 13/02; B24C 1/04

[52] U.S. Cl. ..... 427/444; 51/274; 51/310; 118/503; 118/505; 427/282

[58] Field of Search ..... 118/504, 505, 213, 301, 118/406, 503; 427/282, 444, 300; 51/310-312, 274; 29/156.8 B, 23.5

[56] References Cited

U.S. PATENT DOCUMENTS

| | | | |
|---|---|---|---|
| 2,979,024 | 4/1961 | Pellekaan | 118/504 |
| 3,141,794 | 7/1964 | Horner | 118/505 |
| 3,226,245 | 12/1965 | Dettling et al. | 118/505 |
| 3,482,423 | 12/1969 | Murray et al. | 51/310 |
| 3,708,936 | 1/1973 | Rogers | 51/310 |
| 3,951,701 | 4/1976 | Csillag | 427/282 |
| 4,334,495 | 6/1982 | Derkacs et al. | 118/503 X |

OTHER PUBLICATIONS

DePew, J. R. et al., "Plating Fixture", *IBM Technical Disclosure Bulletin,* vol. 16, No. 4, Sep. 1973, pp. 1318-1319.

*Primary Examiner*—Evan K. Lawrence

*Attorney, Agent, or Firm*—Lee H. Sachs; Derek P. Lawrence

[57] ABSTRACT

A method and apparatus for masking from treatment selected surfaces of a turbine blade. The blade is positioned in an apparatus which includes a holder enclosing the airfoil section of the blade and a distinct spaced apart mask member elastically secured to the holder and having a deformable surface covering a surface of the blade spaced from the airfoil.

6 Claims, 1 Drawing Figure

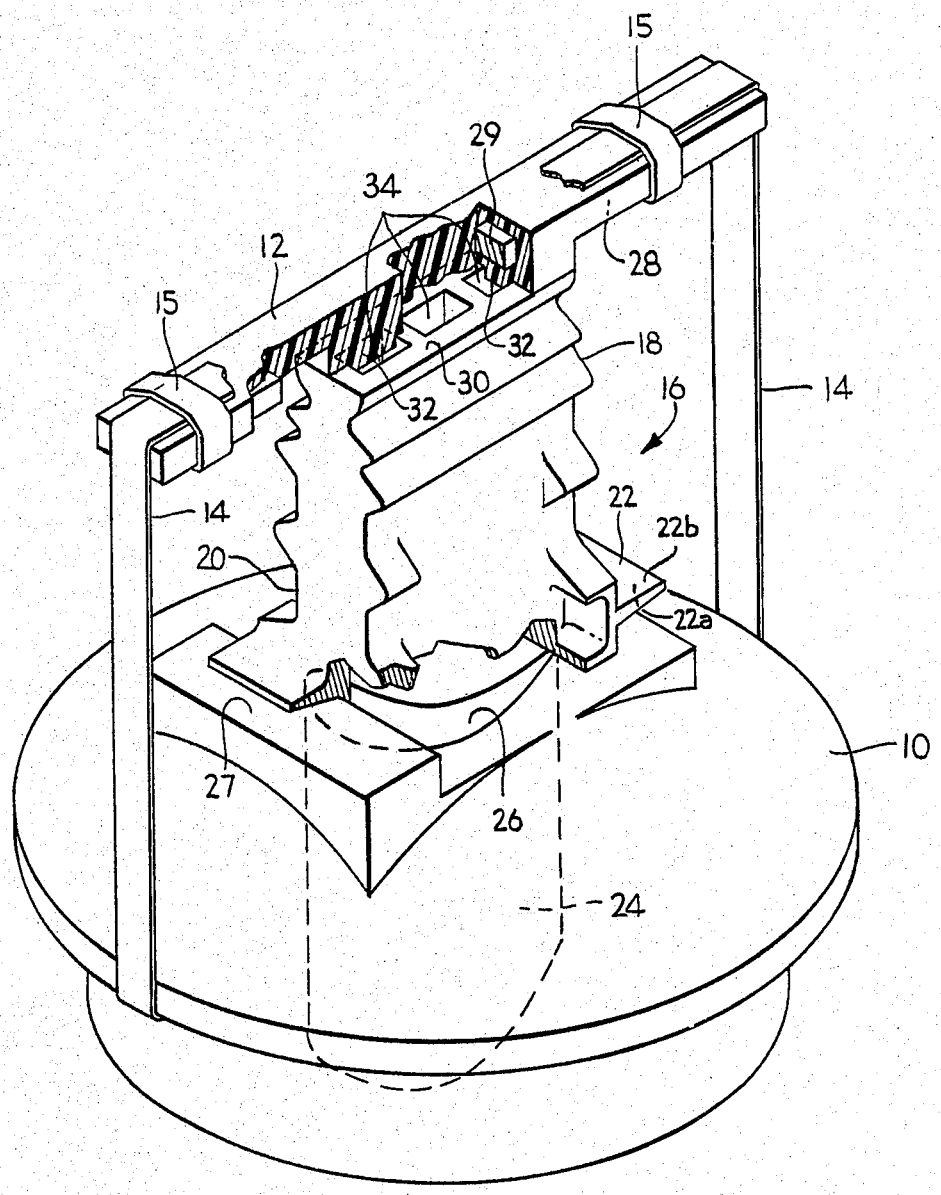
15
29
34
12
28
15
32
18
30
32
16
14
14
22
22b
20
22a
10
27
26
24

METHOD AND APPARATUS FOR MASKING A SURFACE OF A BLADE MEMBER

This invention relates to the selective treatment of an article surface, and, more particularly, to a masking method and apparatus for masking from treatment a selected surface of a blade member.

BACKGROUND OF THE INVENTION

The field of production of articles of manufacture and of repair of such articles include many examples of the treatment of one portion of an article while protecting from treatment another portion of the article. Examples of such treatment include applications of coatings, removal of coatings, mechanical and chemical cleaning of surfaces, removal of selected portions of metallic article surfaces by chemical and electro-chemical type processes and change of surface conditions such as by shot peening.

Widely used forms of masking include the application of adhesive tape and the application of hardenable plastic films applied to or flowed upon selected article surfaces to be protected. Frequently, such methods include subsequent trimming of such a protective medium more accurately about the periphery of the surface to be protected. After treatment, the protective films or tapes must be removed. As can be appreciated, such masking methods are time consuming from a labor viewpoint and can allow detrimental penetration of the treating medium beneath the edge of the protective mask. Other forms of masking have included the mechanical clamping of masks about the surface to be protected. These, too, consume excessive labor time to apply and remove.

SUMMARY OF THE INVENTION

It is a principal object of the present invention to provide an improved masking method which enables accurate masking of a surface of a blade to be protected from treatment while enabling rapid application and removal of the mask from the blade.

It is another object to provide masking apparatus to accomplish such a method and which provides an elastically deformable mask surface and elastic means for securing the mask surface at the surface to be protected to provide accurate protection and ease of application and removal.

These and other objects and advantages will be more clearly understood from the following detailed description, the drawing and the specific examples all of which are intended to be typical of rather than in any way limiting on the scope of the present invention.

The method of the present invention is useful in a method for treating a first portion of a blade member which includes a selected surface to be masked for treatment, the selected surface being spaced from a second portion of the member. The method of the present invention in one form comprises disposing the second portion of the member in a holding means, which in one form of the invention also functions as a mask. Provided as a distinct and separate member from the holding means is a substantially rigid mask member which includes an elastically deformable mask surface and a positioning portion to position the mask surface over the selected surface. Fpor example, one form of the positioning portion includes a protrusion for insertion into a port of the selected surface. For accurate coverage of the selected surface, the mask surface is contoured substantially to that of the selected surface. During one form of the method, the mask surface covers and is positioned with respect to the selected surface, for example with the protrusion within the port, and then the masked member is secured at the selected surface elastically between the masked member and the holding means.

The mask apparatus associated with the present invention is for use with a blade having a first portion to be treated and a second portion, the first portion including a selected surface to be masked. The selected surface is spaced from the second blade portion. Such masking apparatus also includes a holding means to hold the second blade portion. In one form of the invention, the holding means also constitutes a masking means; in another form it includes a locating surface for the article. Also included in the apparatus is a substantially rigid mask member distinct from the holding means and including an elastically deformable mask surface. The mask member has a positioning portion to position the mask surface over the selected surface, for example through a protrusion for insertion into a port in the selected surface to be protected. The mask surface is contoured substantially to the selected surface. Also provided is elastic means, one form of which is an elastic strap, secured between the masked member and the holding means.

BRIEF DESCRIPTION OF THE DRAWING

The sole FIGURE is a perspective, fragmentary, partially sectional view of the masking apparatus of the present invention in a form for use in connection with a turbine engine blade member.

DESCRIPTION OF THE PREFERRED EMBODIMENTS

Certain high temperature operating turbine engine components are exposed during operation to a combination of strenuous conditions, particularly if they are rotating components such as a turbine blade. Because such components generally are manufactured from high temperature alloys, sometimes referred to as "superalloys", a variety of thermal processing can be involved in initial manufacture or in subsequent repair. In addition, such a component can experience thermal cycling during operation. All such thermal processing or cycling can result in loss of strength properties which in most cases is desirable to be restored. Frequently, such restoration of strength properties is accomplished by working or inducing stress into portions of or into the surface of portions of such components.

In the case of a turbine engine turbine blade, an improved condition of surface stress typically is imparted to or is induced into a surface by impacting with particles such as metal shot, in a method sometimes referred to as "shot peening". Because components like such turbine blades operate at high temperatures, it is common to provide air cooling within the hollow interior of the turbine blade and to introduce cooling air through ports in a bottom surface of the blade. It is undesirable to allow the particles used in the shot peening operation to penetrate into the ports and become lodged in the internal air cooling passages of the turbine blade. Therefore, it has been common practice to apply a piece of adhesive tape as a mask over the blade's surface which includes the ports, such surface thus having been selected to be masked from treatment by shot peening particles.

Such a turbine blade typically includes an airfoil portion which is separated from a shank and a base or dovetail portion by a platform. Generally, it is undesirable or unnecessary to treat as by shot peening the airfoil and the upper platform area adjacent to the airfoil. Accordingly, practice has been to mask, as with adhesive tape, portions of the airfoil for protection from the impacting particles. It has been recognized, however, that the force of the impacting particles or shot has a tendency to lift or remove at least part of the masking tape thereby exposing for shot peening or shot penetration those portions of the article which are desired to be protected. Application of other similar masking arrangements such as the application of masking paints and hardenable plastic films can be subject to the same undesirable conditions described above. In addition, such masking arrangements are relatively costly to apply and to remove from a labor cost viewpoint.

The present invention provides an efficient, rapidly and easily appliable and removable masking arrangement which is reuseable. With reference to the FIGURE, such an arrangement includes a holding means 10, a mask member 112 distinct from the holding means, and an elastic means 14 secured between mask member 12 and holding means 10. Also shown in fragmentary sectional view in the FIGURE is an article to be treated, in the form of a gas turbine engine turbine blade 16, including a dovetail or base 18, a shank portion 20, a platform 22, and an airfoil portion 24. Platform 22 includes a first or lower surface **22*b* facing the base and a second or upper surface 22*a* facing the airfoil 24, shown in phantom within holding means 10. Holding means 10 is adapted to hold the airfoil portion 24 by the insertion of the airfoil through an airfoil shaped opening 26 in holding means 10. Opening 26 is shaped substantially to the periphery of airfoil 24 to provide a relatively close but releasable fit. This allows ease of insertion and removal but yet provides a sufficiently close fit to avoid penetration of the treating medium such as shot toward the masked portion of airfoil 24. In one form, the holding means includes a locating surface 27, for example for cooperation with platform surface 22*a* in locating or limiting penetration of the blade airfoil 24 into the holding means 10**.

Mask member 12 is substantially rigid and includes a mask surface 28 which is contoured substantially to surface 30 of dovetail 18 and is elastically deformable to provide a relatively tight fit with the surface 30 selected to be masked. Mask member 12 includes at least one positioning portion such as protrusion 32, two of which are shown in the drawing, projecting from mask surface 28. The protrusion is adapted to be inserted into a port 34, three of which are shown in selected dovetail surface 30 of the turbine blade in the drawing. Mask member 12 can be of a single piece or of multiple elements, for example a first member carrying mask surface 28 and protrusion 32 secured with a second or backing member. In that form, the first and second members together define the mask member 12. Because of the close fit between mask surface 28 of mask member 12 and selected base or dovetail surface 30, protrusion 32 is for positioning of surface 28 and to prevent rotation of mask member 12 away from surface 30 rather than for blocking or masking port 34, already accomplished by the contact between surfaces 28 and 30. Elastic means or strap 14 is operatively connected with mask member 12 such as by passing over member 12 and being secured thereto by holders 15. In the form of the masking apparatus of the present invention shown in the drawing, there are provided two masking means; mask member 12 for the selected surface of dovetail 18 and holding menas 10 through its opening 26 masking a portion of airfoil 24. In the drawing, surface 27 of holding means 10 limits the penetration of blade airfoil 24 through opening 26 by its contact or registry with platform surface **22*a*. Surface 27 in cooperation with platform surface 22*a* control relative positioning of blade 16 and holding means 10**.

It is preferred and desirable to construct the apparatus of the present invention to resist the treating medium. For example, if the masking is for use with shot peening, a preferred material of construction for holding means 10 and mask member 12 is a resilient type of material such as a plastic from which the shot can rebound without significant effect on the masking apparatus material. In such a case, for example, with the use of non-metallic, polyurethane plastic as the material of construction for such members, the elastically deformable mask surface 28 is inherently provided in the mask member 12. It is desirable in those cases in whch the plastic material does not provide sufficient rigidity to the mask member, to attach to or encapsulate in the mask member a rigid member or bar, such as metal member 29 in the drawing, to provide adequate rigidity. This enables elastic means such as strap 14 to draw mask member 12 toward holding means 10, pressing elastically deformable mask surface 28 against selected surface 30 without substantial deflection of member 12.

An example of practice of the method of the present invention involves the use of an article such as the gas turbine engine turbine blade 16 having a first portion comprising dovetail 18, shank 20, and surface **22*b* of platform 22 facing shank 20, and a second portion comprising surface 22*a* of platform 22 and airfoil 24. The second portion or airfoil 24 is inserted through the airfoil shaped opening 26 in holding means 10 until platform surface 22*a* engages the locating surface 27 of holding means 10 with opening 26 releasably about the airfoil. In this way, surface 30 which has been selected to be masked from treatment and spaced from the second portion or airfoil is made available for contact with mask member 12 at mask surface 28. Elastic means 14 which secures mask member 12 to holding means 10 is stretched to move mask member 12 elastically away from holding means 10. Positioning protrusion 32 is then inserted into port 34, with elastic means or strap 14 urging together mask surface 28 and surface 30 in a sealing relationship. Also, platform surface 22*a* and locating surface 27** are urged together. With this arrangement, the gas turbine engine turbine blade is masked for treatment such as by shot peening through the placement of the apparatus into a shot peening cabinet conveniently with the holding means carried by a table within the shot peening enclosure.

The present invention has been described in connection with specific examples and embodiments, for example in connection with shot peening. However, it will be understood by those skilled in the art related to article processing and treatment that the present invention can be applied in a variety of ways in other embodiments and in other treatment systems without departing from the scope of the invention as defined by the appended claims.

What is claimed is:

1. A method for masking portions of a member, wherein said member is a metallic blade comprising a first portion having a base, a platform first surface facing the base, and a shank therebetween, and a second portion having an airfoil connected to a platform second surface facing the airfoil, the base having a surface selected to be masked from treatment and including a port therein, the selected surface being spaced from the second portion, the method for masking the selected surface of the base, the airfoil and the second platform surface comprising the steps of:

disposing the airfoil in a holding means through an opening in the holding means shaped to releasably enclose the periphery of the airfoil;

providing a substantially rigid mask member which is distinct from the holding means and which includes an elastically deformable mask surface having a positioning protrusion for insertion into the port, the mask surface being contoured substantially to the selected base surface;

covering the base surface with the mask surface, with the protrusion within the port; and then, securing the mask member at the base surface elastically with an elastic means between the mask member and the holding means, the elastic means pressing the platform second surface against the holding means.

2. The method of claim 1 in which the holding means and the mask member are made of resilient material.

3. Masking apparatus for use with a turbine engine blade member which includes a first portion to be treated comprised of a base having a base surface selected to be masked from treatment and including a port therein, a platform having a first surface facing the base, and a shank therebetween, the blade member also including a second portion comprising an airfoil extending from the platform at a second platform surface facing the airfoil, the selected surface being spaced from the second portion, the masking apparatus comprising:

an airfoil holding means including an opening therein shaped to the contour of the air foil of the blade member to releasably hold and enclose the airfoil portion;

a substantially rigid mask member distinct from the airfoil holding means and including an elastically deformable mask surface having a positioning protrusion for insertion into the port and contoured substantially to the selected base surface; and elastic strap means secured between the mask member and the airfoil holding means.

4. The apparatus of claim 3 in which the airfoil holding means and the mask member are of a non-metallic, resilient material.

5. The apparatus of claim 4 in which the mask member includes a rigidizing bar to provide rigidity to the mask member.

6. The apparatus of claim 3 in which the airfoil holding means includes a locating surface adapted to cooperate with the second platform surface to control relative positioning of the blading member and the airfoil holding means.

* * * * *